United States Patent [19]

Wang

[11] Patent Number: 5,044,085

[45] Date of Patent: Sep. 3, 1991

[54] TABLE-TOP COPYING MACHINE

[76] Inventor: Tian-Wang Wang, No. 45, Yi Chang E. Rd., Tai Ping Hsian, Taichung Hsien, Taiwan

[21] Appl. No.: 658,151

[22] Filed: Feb. 20, 1991

[51] Int. Cl.[5] ..... B43L 13/12

[52] U.S. Cl. ..... 33/23.03

[58] Field of Search ..... 33/23.01, 23.02, 22, 33/23.03

[56] References Cited

U.S. PATENT DOCUMENTS 3,171,207 3/1965 Worser ..... 33/23.03

3,777,616 12/1973 Mueller ..... 33/23.03 X

*Primary Examiner*—Harry N. Haroian

*Attorney, Agent, or Firm*—Varndell Legal Group

[57] ABSTRACT

A table-top copying machine comprising a H-shaped sliding frame assembly mounted to slide forward and backward on the base frame thereof, a copying mechanism mounted to slide leftward and rightward on said H-shaped sliding frame assembly, a first positioning mechanism for holding block-shaped working piece and model, and a second positioning mechanism for holding flat-shaped working piece and model. By means of the control of the H-shaped sliding frame assembly and the copying mechanism itself, working piece and model can be moved forward, backward, leftward and rightward. By means of the control of the first positioning mechanism, working piece and model can be rotated vertically.

2 Claims, 2 Drawing Sheets

TABLE-TOP COPYING MACHINE

BACKGROUND OF THE INVENTION

In U.S. Pat. No. 4,910,872, a hand-operated copying machine is disclosed to efficiently and precisely perform copying process horizontally as well as vertically on any working piece of any shape through alternative adjustment of a positioning adjusting mechanism and a vertical fixture assembly. However, the cited hand-operatted copying machine occupies much space in vertical direction and is not suitable for table-top operation.

Therefore, it is the main object of the present invention to provide a compact copying machine which is suitable for copying operation on table top. It is another object of the present invention to provide a compact copying machine which has means respectively provided for holding block-shaped or flat-shaped working piece and model for performing precise copying process.

DETAILED DESCRIPTION OF THE PREFERRED EMBODIMENT

Figure 1:
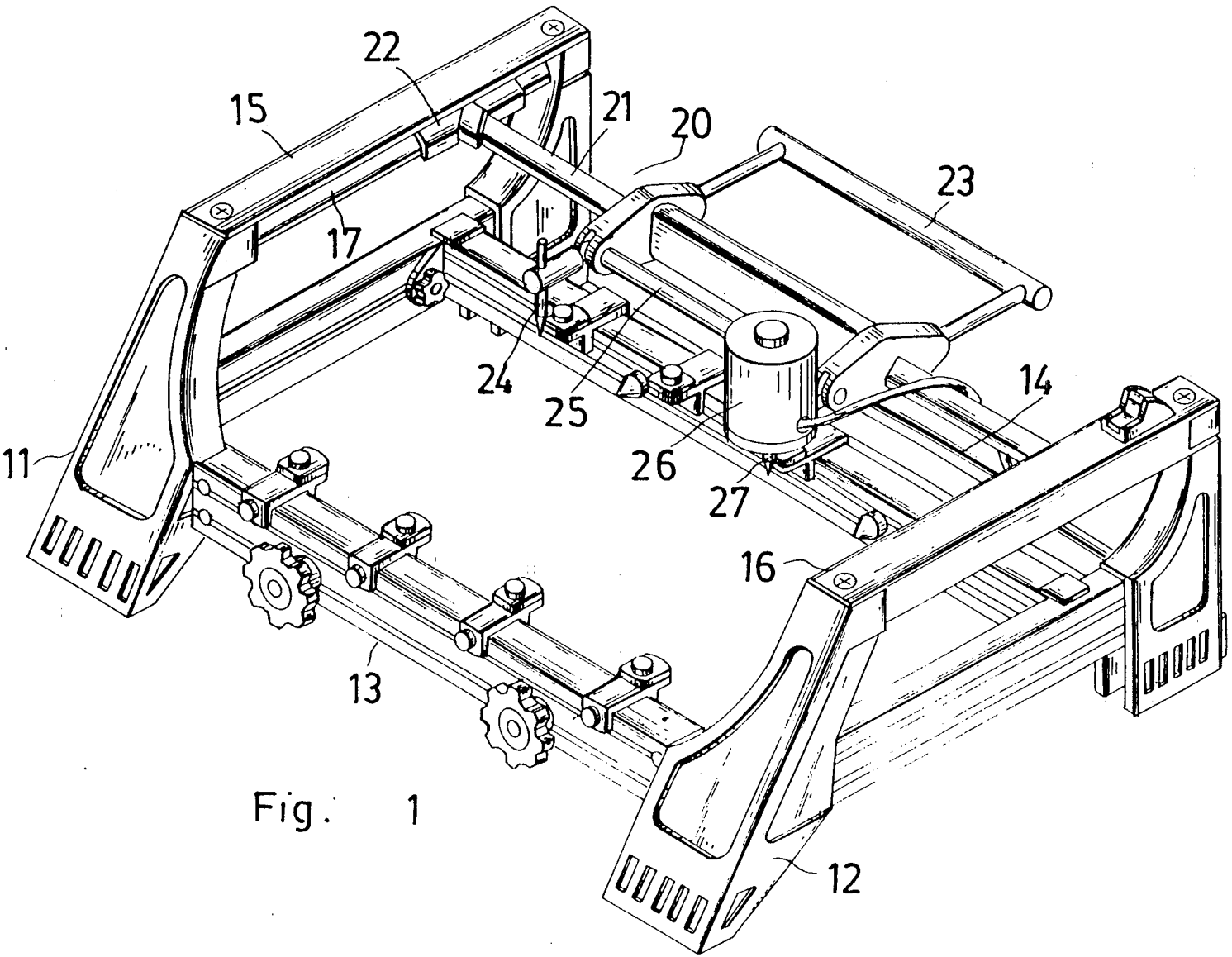
FIG. 1 is a perspective view of the preferred embodiment of the table-top copying machine of the present invention.

Referring to FIG. 1, a copying machine in accordance with the present invention is generally comprised of a base frame assembly, a H-shaped sliding frame assembly, a copying mechanism, a movable cross bar assembly, a first positioning mechanism and a second positioning mechanism.

The base frame assembly is generally comprised of two opposite side frames 11 and 12, a front cross bar 13 and a rear cross bar 14. There is provided two parallel rails 17 respectively disposed below the upper part 15 or 16 of the two opposite side frames 11 and 12 for sliding thereon of a H-shaped sliding frame assembly 20. The H-shaped sliding frame assembly 20 comprises a cross rod 21 having two T-shaped sliding connectors 22 at two opposite ends respectively movably mounted on the two parallel rails 17 of the two opposite side frames 11 and 12. By means of the T-shaped sliding connectors 22, the cross rod 21 is permitted to slide horizontally forward and backward along the rails 17. The copying mechanism is comprised of a balance bar 23 mounted on the cross rod 21 of the H-shaped sliding frame assembly 20 and having connected thereto a copying rod 24, a connecting rod 25, a motor 26 and a copying tool 27. the balance bar 23 of the copying mechanism is permitted to slide leftward and rightward on the cross rod 21 of the H-shaped sliding frame assembly 20. Therefore, by means of the relative motion of the cross rod 21 on the rails 17 and the balance bar 23 on the cross rod 21, the copying mechanism can be moved to slide transversely as well as longitudinally on the same plane.

Figure 2:
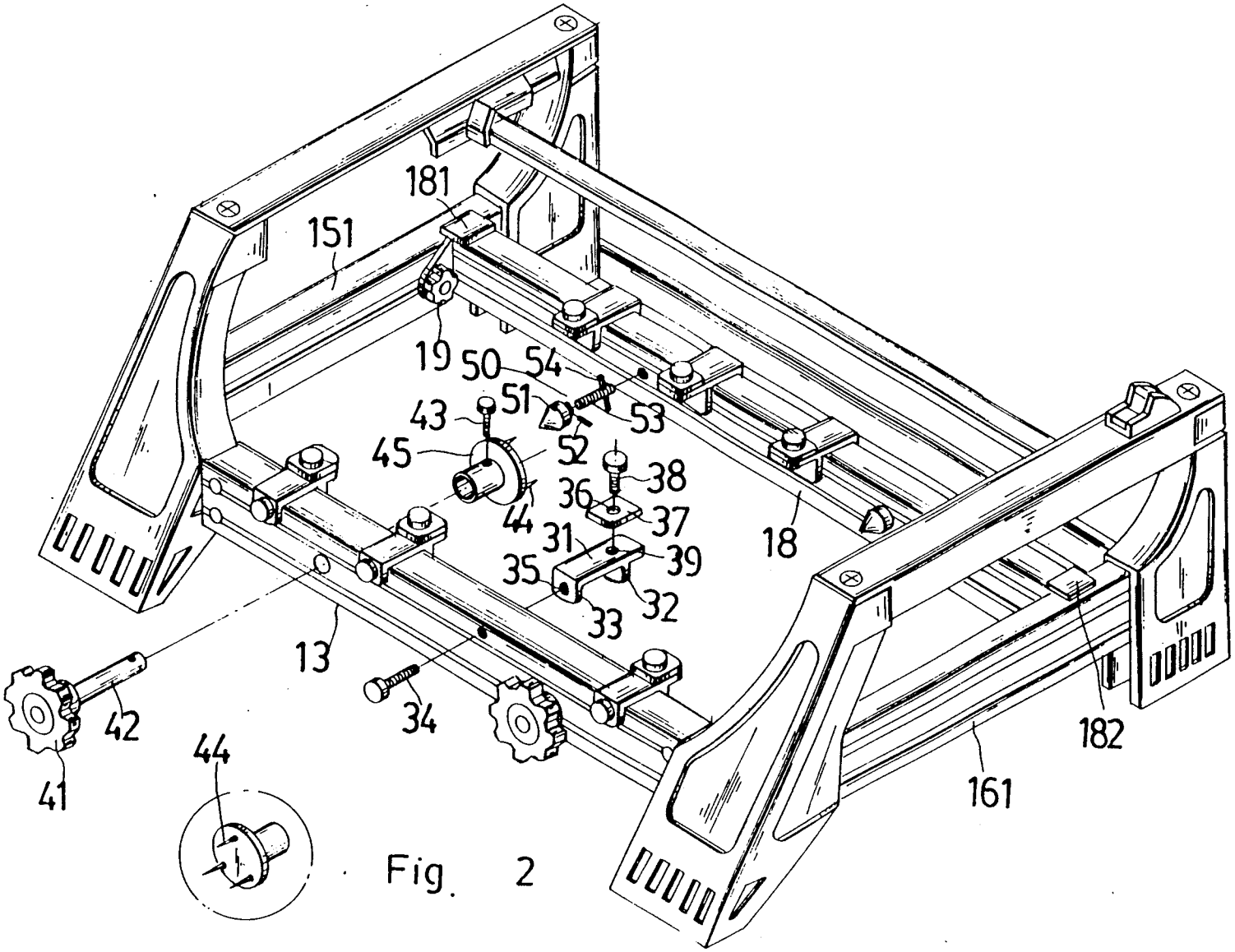
FIG. 2 is a partly perspective fragmentary view thereof, showing the structure of the first and second positioning mechanism.

Referring to FIG. 2, the movable cross bar assembly is generally comprised of a movable cross bar 18 movably mounted between the two opposite side frames 11 and 12 and the front and rear cross bars 13 and 14 at a lower position. As illustrated, the movable cross bar 18 has two bearing plates 181 and 182 at two opposite ends respectively supported at the lower parts 151 and 161 of the two opposite side frames 11 and 12 and secured in position by lock screws 19. By means of the control of the lock screws 19, the movable cross bar 18 can be firmly retained at either location on the lower parts 151 and 161 of the two opposite side frames 11 and 12.

Referring to FIG. 2 again, the first positioning mechanism which is provided for holding block-shaped working piece and model is comprised of a plurality of tri-lock retainer devices and a plurality of mono-lock retainer devices. The tri-lock retainer device comprises an adjusting knob 41 having a bolt 42 inserted through the front cross bar 13 at a suitable location, a tri-lock locking member 45 connected to said bolt 42 by a screw 43 which has three pins 44 disposed at three angles and respectively projecting toward the movable cross bar 18. Each mono-lock retainer device 50 comprises a screw rod 53 fastened in the movable cross bar 18, a lever 54 fastened in said screw rod 53 and controlled by the hand to drive said screw rod 53 to rotate, a cone 51 connected to said screw rod 53 by a screw 52 with the sharp point thereof projecting toward the front cross bar 13. The tri-lock and mono-lock retainer devices are respectively aligned. Rotating the lever 54 causes the cone 51 to move forward or backward so that block-shaped working piece and model can be firmly retained between the cone 51 and the three pins 44 of the tri-lock locking member 45 or released therefrom. Rotating the adjusting knob 41 causes the tri-lock locking member 45 to carry the working piece or model to rotate in vertical direction against the moving direction of the movable cross bar 18.

Referring to FIG. 2 again, the second positioning mechanism which is provided for holding flat working piece and model is comprised of a plurality pairs of locating plates 31 symmetrically mounted on the front cross bar 13 and the movable cross bar 18. Each locating plate 31 has two unitary legs 32 and 33 retained at the two opposite sides of the front cross bar 13 or the movable cross bar 18, which legs 32 and 33 have each a bolt hole 35 through which a screw 34 is fastened to secure the locating plate 31 to the front cross bar 13 or the movable cross bar 18, and a top edge having a bolt hole 39 for securing a clamping plate 37 thereto, which clamping plate 37 has a bolt hole 36 through which a crew 38 is fastened in the bolt hole 39 of the locating plate 31. By means of the clamping plate 37 and/or the locating plate 31, flat-shaped working piece and model can be firmly retained between the front cross bar 13 and the movable cross bar 18 for copying operation.

What is claimed is:

1. A table-top copying machine, comprising:

a base frame assembly movably mounted on the top surface of a table for performing copying operation, comprised of two opposite side frames, a front cross bar and a rear cross bar;

a H-shaped sliding frame assembly comprising a cross rod having two T-shaped sliding connectors at two opposite ends respectively mounted on said two opposite side frames to move horizontally forward and backward thereon;

a copying mechanism carried by said H-shaped sliding frame assembly to move righward and leftward, comprising a balance bar mounted on said cross rod of said H-shaped sliding frame assembly, having connected thereto a copying rod, a connecting rod, a motor and a copying tool;

a movable cross bar movably secured between said two opposite side frames and said front and rear cross bars by lock screws;

a first positioning mechanism comprised of a plurality of tri-lock retained devices and a plurality of mono-lock retainer devices for holding a block-shaped working piece and model therebetween, said tri-lock retainer devices comprising each an adjusting knob having a bolt inserted through said front cross bar, a tri-lock locking member connected to said bolt by a screw, said tri-lock locking member having three pins disposed at three angles and respectively projecting toward said movable cross bar, said mono-lock retainer devices comprising each a screw rod fastened in said movable cross bar, a lever fastened in said screw rod to drive it to rotate, and a cone connected to said screw rod by a screw with the sharp point thereof projecting toward said tri-lock locking member; and a second positioning mechanism comprised of a plurality of pairs of locating plates symmetrically mounted on said front and movable cross bar for holding a flat working piece and model therebetween, said locating plates comprising each two unitary legs retained at the two opposite sides of said front or movable cross bar, and a clamping plate secured thereto at the top.

2. The table-top copying machine of claim 1, wherein said second positioning mechanism can be attached to or removed from said base frame assembly and said movable cross bar according to different copying purpose.

* * * * *